US005155880A

United States Patent [19]

Schoonover et al.

[11] Patent Number: 5,155,880

[45] Date of Patent: Oct. 20, 1992

[54] APPARATUS AND METHOD FOR INCREASING VERTICAL MATTRESS ADJUSTMENT IN FULL SIZE BABY CRIBS

[76] Inventors: Carleton M. Schoonover; Florence M. Schoonover, both of 1925 W. Lake Dr., Burlington, N.C. 27215

[21] Appl. No.: 878,381

[22] Filed: May 4, 1992

[51] Int. Cl.[5] ..... A47D 7/02; A47D 7/03

[52] U.S. Cl. ..... 5/100; 256/22

[58] Field of Search ..... 5/100, 93.1, 424, 428, 5/425; 256/112

[56] References Cited

U.S. PATENT DOCUMENTS 2,641,772 6/1953 Cook ..... 5/100

3,641,598 2/1972 Feldstein ..... 5/100

3,649,973 3/1972 Benoit et al. ..... 5/100

3,911,510 10/1975 Bryant ..... 5/100

*Primary Examiner*—Alexander Grosz

[57] ABSTRACT

A baby crib has a first and a second gate which are substantially planar, parallel and vertical, are spaced apart from each other and are slidingly attached to posts so as to move in a vertical direc ion between the bottom open position and a top closed position. A planar mattress support platform is positioned between said gates and is releasably attached to said posts being perpendicular thereto. A stop means is fixedly attached to said mattress support platform and protrudes horizontally therefrom, and keeper means is fixedly attached to said first gate in a position to engage said stop means when said gate is supported in a position intermediate said top closed position and said bottom open position.

7 Claims, 5 Drawing Sheets

APPARATUS AND METHOD FOR INCREASING VERTICAL MATTRESS ADJUSTMENT IN FULL SIZE BABY CRIBS

BACKGROUND FIELD OF INVENTION

1. Manufactured full size baby cribs with dropside gates have had vertical mattress adjustments of only 8 to 9 inches for many years.

It's desirable to increase this because: (1) a new mother with a new baby needs the top of the mattress about 36 inches above the floor to eliminate stooping because an infant always goes in and comes out of the crib in a horizontal attitude and (2) as the baby grows and begins to pull up to a standing position, the top of the mattress needs to be only 18 inches above the floor which would provide maximum possible vertical wall protection.

Instead of an adjustment of 8 to 9 inches, it should be the difference between 36 and 18 or about 18 inches.

2. Description of the Prior Art

Heretofore all manufactured prior art cribs with dropside gates have used gates about 28 inches in height and these gates were provided with vertical travels of about 7 inches. The gates had only two positions full up and locked and full down and unlocked. Practice dictated that even when the gate was full down, its top should be higher than the top of the mattress for all mattress positions to provide a minimum of gate down protection.

There's good reason for these parameters being almost identical from manufacturer to manufacturer in the prior art and the reason is safety. An unintentional consequence of this is that vertical mattress adjustments are limited to just 8 or 9 inches and cannot be increased without sacrificing safety.

More recently, a Code of Federal Regulations evolved to advance crib safety and it contains sections pertaining to mattress positions.

CFR16-1508.3 (b) 1: The height of the rail and end panel as measured from the top of the rail or panel in its lowest position to the top of the mattress support in its highest position shall be at least 22.8 centimeters (9 inches).

CFR16-1508.3 (b) 2: The height of the rail and end panel as measured from the top of the rail or panel in its highest position to the top of the mattress support in its lowest position shall be at least 66 centimeters (26 inches).

When the mattress is in its highest position, Regulation (b) 1 protects newborn infants in the following way. Suppose the parent has just lowered the gate to its down position and suddenly an older child screams. If the parent then leaves while the infant is still in the crib, the 9 inch requirement prevents the top of the gate from being below the top of the mattress. Assuming a 5½ inch thick mattress there is a wall of 3½ inches in height preventing the horizontal infant from rolling to the floor even though the gate is down. The 9 inch dimension is shown at the left of FIG. 1 as HD.

When the mattress is in its lowest position, Regulation (b) 2 protects a toddler by requiring a wall height high enough to prevent the standing up toddler from falling over the top. It is desirable that the 26 inch requirement of Regulation (b) 2 be increased because after some years of Governmental and Foundational emphasis on the other elements of crib safety, most crib accidents today are the "over-the-top" accidents. The Danny Foundation, Alamo, CA, has on record incidents of precocious child "climbers" going over the top as early as 8 or 9 months of age even with Regulation (b) 2 in effect. The 26 inch requirement is shown to the left of FIG. 2 as HU.

The above background and regulations has caused the function of prior art dropside cribs to be very standard and almost identical from manufacturer to manufacturer. Because the gates are about 28 inches in height, because the gate vertical travels are about 7 inches, and because there are only two gate positions—full up and locked and full down and unlocked, the vertical mattress adjustment is restricted to just 8 to 9 inches.

Any larger vertical mattress adjustment in prior art cribs would sacrifice crib safety.

SUMMARY OF THE INVENTION

The object of the invention is to increase the vertical mattress adjustment of any full size baby crib to about 18 inches and at the same time meeting and exceeding all Federal requirements pertaining to crib safety.

It is accomplished by four elements:

(1) Adding to prior art cribs a cooperative stopkeeper pair. This pair functions only when the mattress is in its highest position and limits the downward travel of the gate to establish an intermediate gate down position in between the full up and locked and the full down and unlocked positions. This intermediate gate down position meets the 9 inch minimum requirement of CFR16 1508.3 (b) 1 and for safety reasons it is positive and cannot be bypassed.

(2) Using a gate about 31½ inches in height. As prior art gates are about 28 inches in height, this is an increase of about 13%.

(3) Using construction to allow about 9½ inches of vertical travel for the enlarged gate. As prior art gate travel is about 7 inches, this is an increase of about 36%.

(4) Using construction to allow the top rail to be 44 inches above the floor. As prior art top rails average 41½ inches, this is a small increase of 6%.

These four elements constitute the invention. Some variation in the gate height, gate travel and top rail height can be made but no combination of dimensions will fulfill the safety requirments without the stopkeeper cooperative pair. This pair is one of the most reliable of all mechanisms and has been used in many machines and manufactures where a distance traversed must be controlled or held to zero. After a diligent search, we can find no instance where it has been used on a baby crib.

The result of the invention is surprising for it permits new crib constructions with vertical mattress adjustments of about 18 inches and where all Federal regulations are met or exceeded. It appears to be a new and useful improvement to prior art manufacturing.

REFERENCE NUMBERS USED IN THE DRAWINGS

30 Mattress
31 Stop
32 Keeper
33 Mattress Support Platform
34 Top Rail
35 Guide Rod
36 Crib Post
37 Gate Assembly
38 T-Bar Guide

PREFERRED EMBODIMENT

Figure 3:
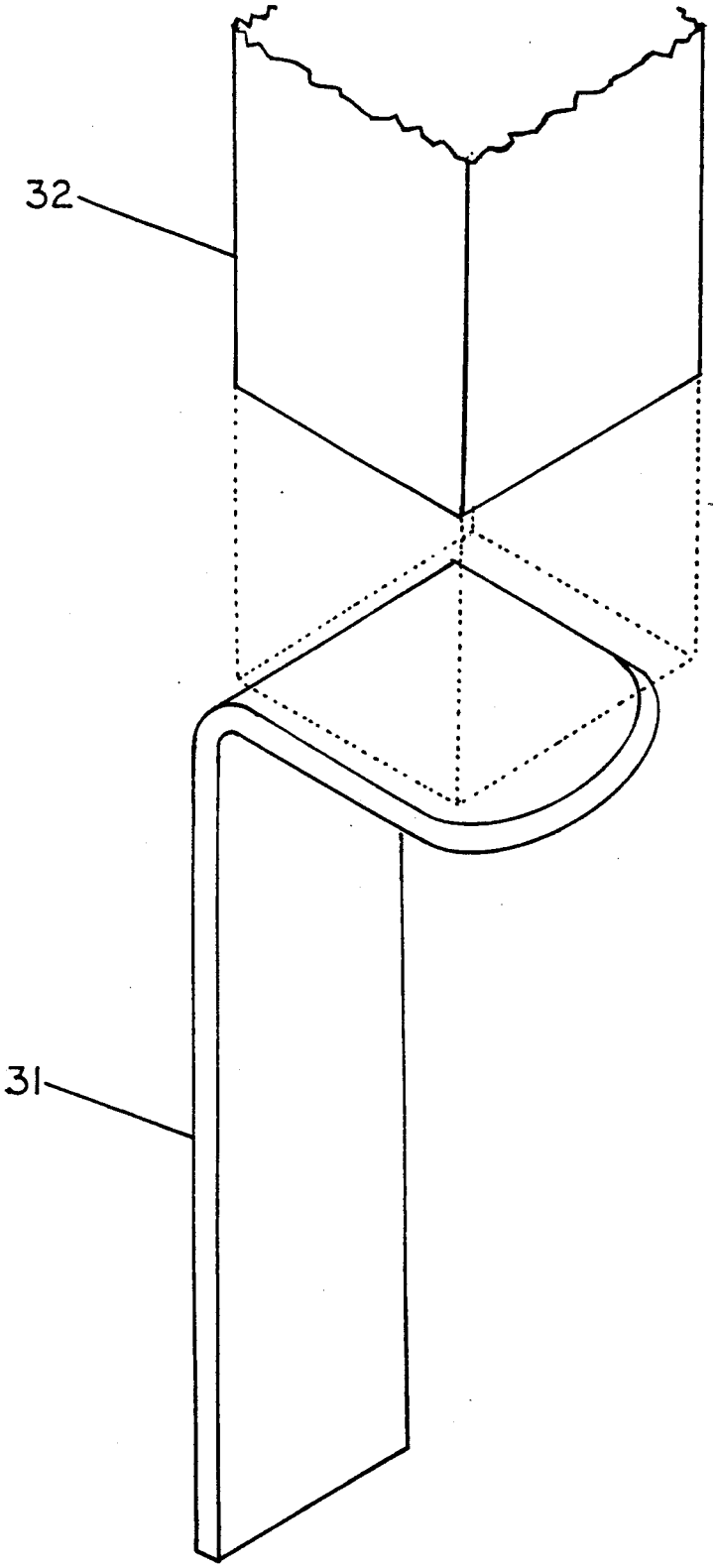
FIG. 3 is an isolated perspective view of the stop and the keeper.

FIG. 3 shows one stop-keeper pair in isolated perspective.

Figure 4:
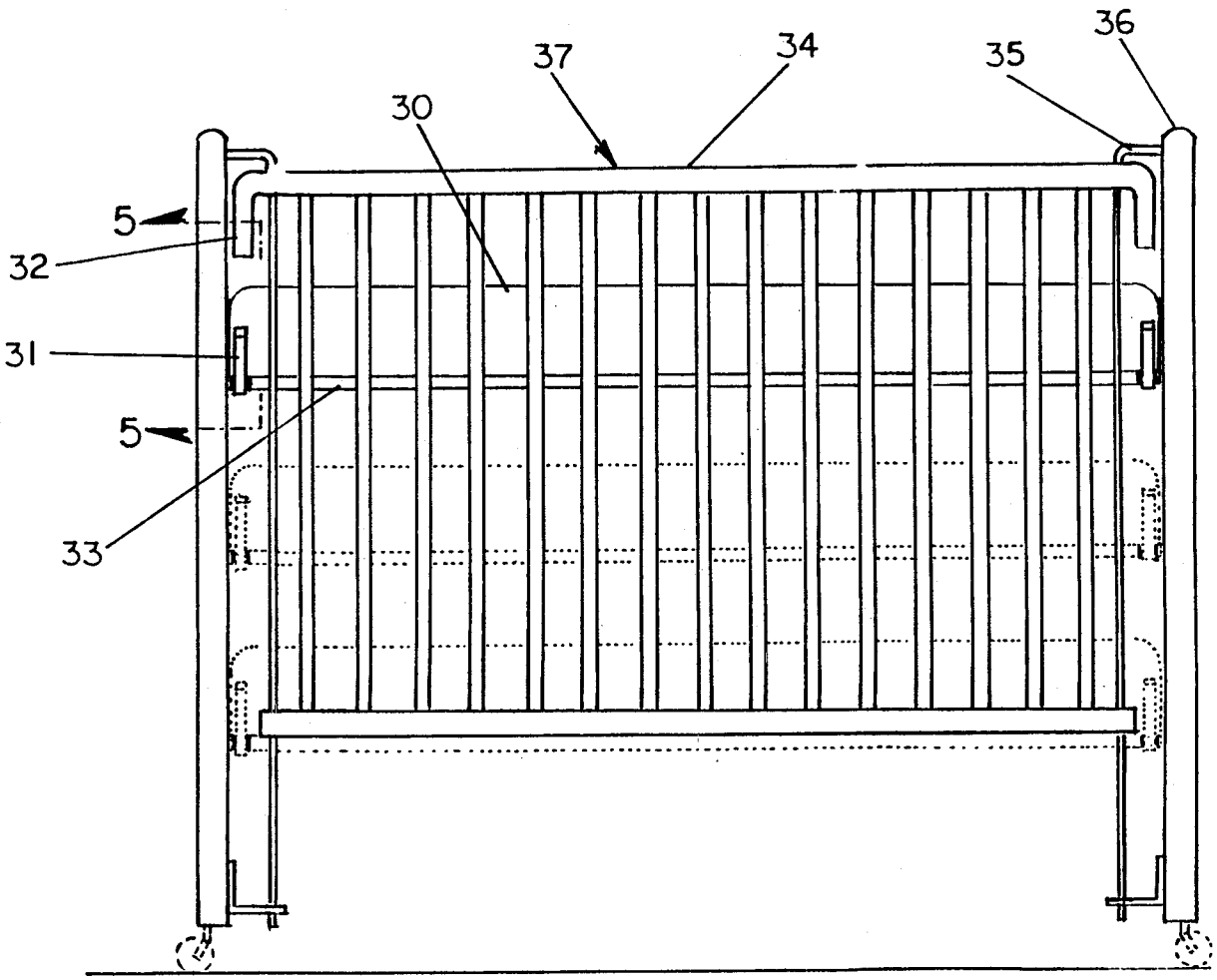
FIG. 4 is an elevation view showing the locations of the stop-keeper pairs in the preferred embodiment.
Figure 5:
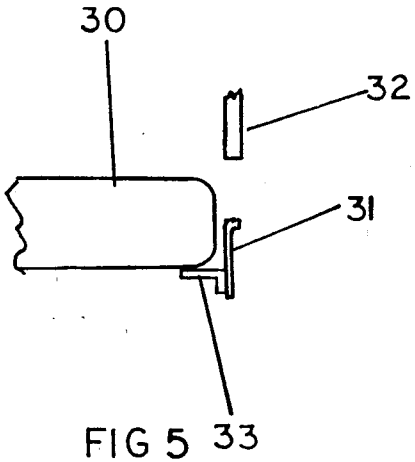
FIG. 5 is a cross section elevation of FIG. 4.

The preferred embodiment is shown in FIGS. 4 and 5 where the gate 37 is in its full up and locked position. The keepers 32 are part of the gate 37 and the stops 31 are rigidly welded to the steel mattress support platform 33. A stop-keeper pair is employed at each end of the crib located between the guide rods 35 and the crib posts 36. In FIG. 4 the distance between the guide rod 35 and the post 36 has been enlarged for clarity. It needs to be between 1½ to 2 inches at the most.

The pairs are assigned vertical heights so that when the mattress 30 is in its highest position and the gate 37 is up and locked, there is an airspace of about 4½ inches between each keeper 32 and its stop 31.

When the gate is unlocked and lowered, the moving keepers 32 contact and rest on the stationary stops 31. The heights assigned to the cooperative pair assure in a positive manner that the gate cannot be lowered more than the 9 inch requirement of CFR16 1508.3 (b) 1 shown in FIG. 1.

Figure 6:
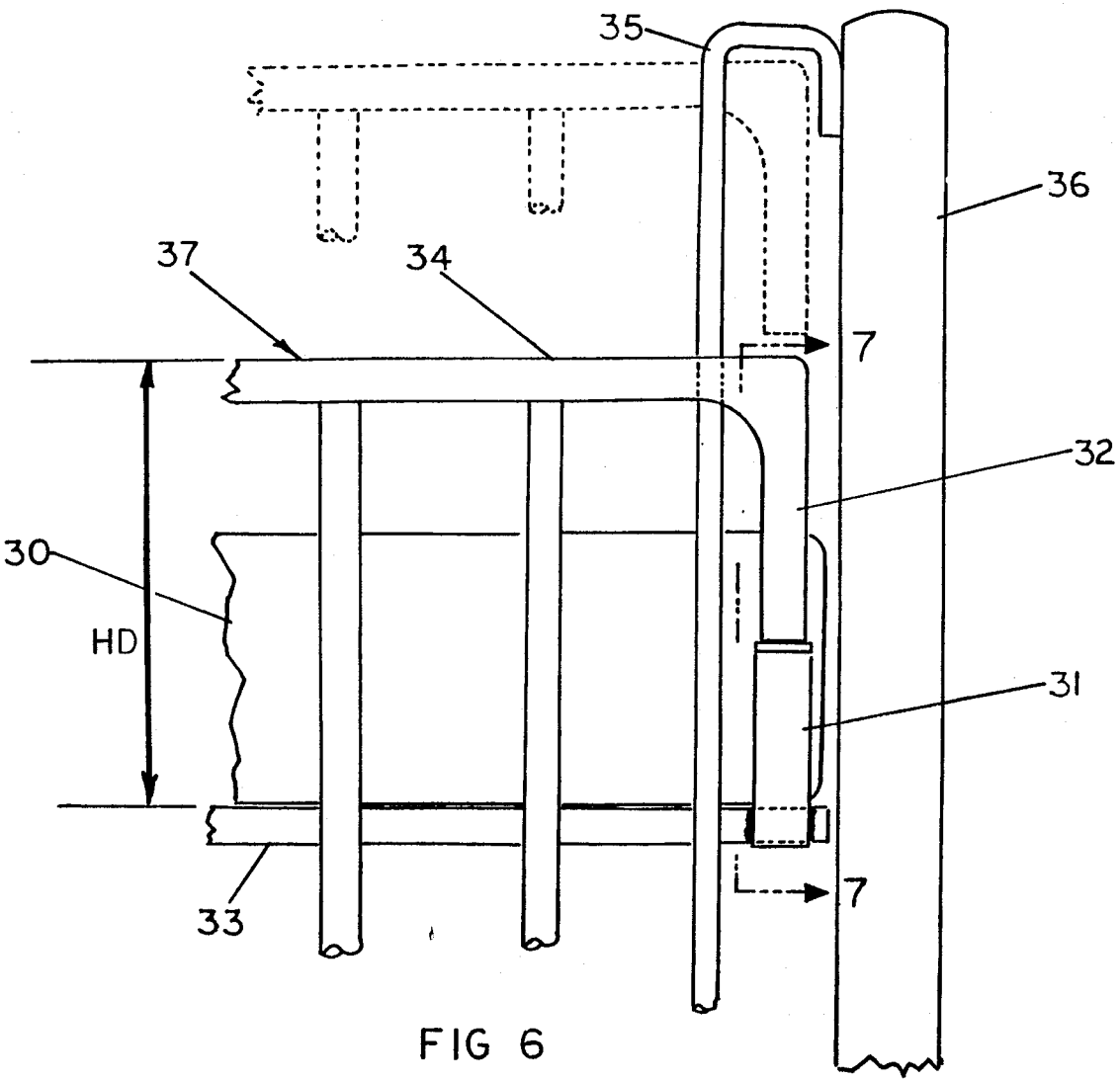
FIG. 6 is a larger scale elevation of one stop-keeper pair of FIG. 4.
Figure 7:
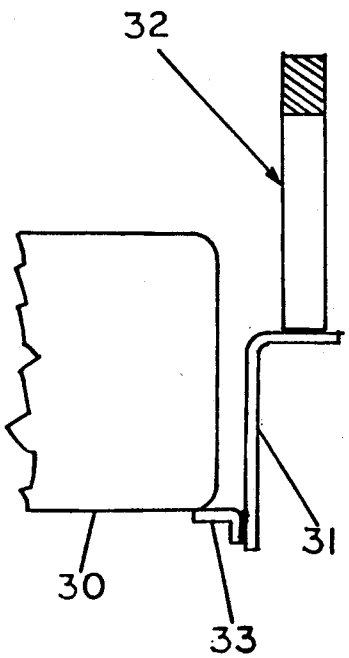
FIG. 7 is a cross section elevation of FIG. 6.

FIGS. 6 and 7 show one of the pairs of FIG. 4 in larger scale after the gate 37 has been lowered 4½ inches and the keepers 32 now are in contact with the stops 31 creating an intermediate gate down position in between the full up and full down positions. The 9 inch requirement is shown as HD. Assuming a mattress thickness of 5½ inches, there is a 3½ inch high vertical wall to prevent newborn infants from rolling to the floor even though the gate is down.

When the mattress is lowered to another position the stops 31, now useless, go down with the mattress support platform 33 and will not interfere with the gate 37 when it goes to its full down and unlocked position. This is true because of the extra height of the gate in this invention.

The stop-keeper pairs can take many forms and be in many locations but they must always have these characteristics:

(1) The stops 31 are part of or appurtenant to and carried by the mattress support platform 33. They are rigidly and permanently attached by wood screws, machine screws, or welding depending on the materials of the mattress support platform.

(2) The keepers 32 are part of or appurtenant to and carried by the gate 37. As gates are usually of wood, rigid and permanent methods of attachment would be wood screws, dowelling, glueing or mortise and tenon.

Referring again to FIG. 4, the following approximate dimensions in inches apply:

| Mattress Position | Floor to Top of Mattress, 30 | Top of Mattress, 30 to top of Top Rail, 34 |
|---|---|---|
| High | 36 | 8 |
| Medium | 27 18 | 17 |
| Low | 18 | 26 |

The preferred embodiment has achieved the purpose of the invention and has met or exceeded all safety regulations. Note that the difference between the floor to top of mattress dimensions of 36 and 18 provides a vertical mattress adjustment of 18 inches. Also, when the mattress is in its lowest position and the top of mattress to top of top rail dimension is 26 inches and the thickness of the mattress is added, the CFR15 1508.3 (b) 2 requirement has been exceeded by about 6 inches which is a significant improvement in crib safety.

Other dimensions that apply to FIG. 4:

| | |
|---|---|
| Floor to top of top rail, 34 | ~44 inches |
| Gate, 37, height | 31½ inches |
| Floor to bottom of gate, 37, when gate is full down | 3 inches |
| Gate, 37, travel full up to full down | 9½ inches |

ALTERNATE EMBODIMENT

The preferred embodiment assumes the gate locking and release mechanism is under the mattress support platform in a location the baby cannot reach.

Figure 8:
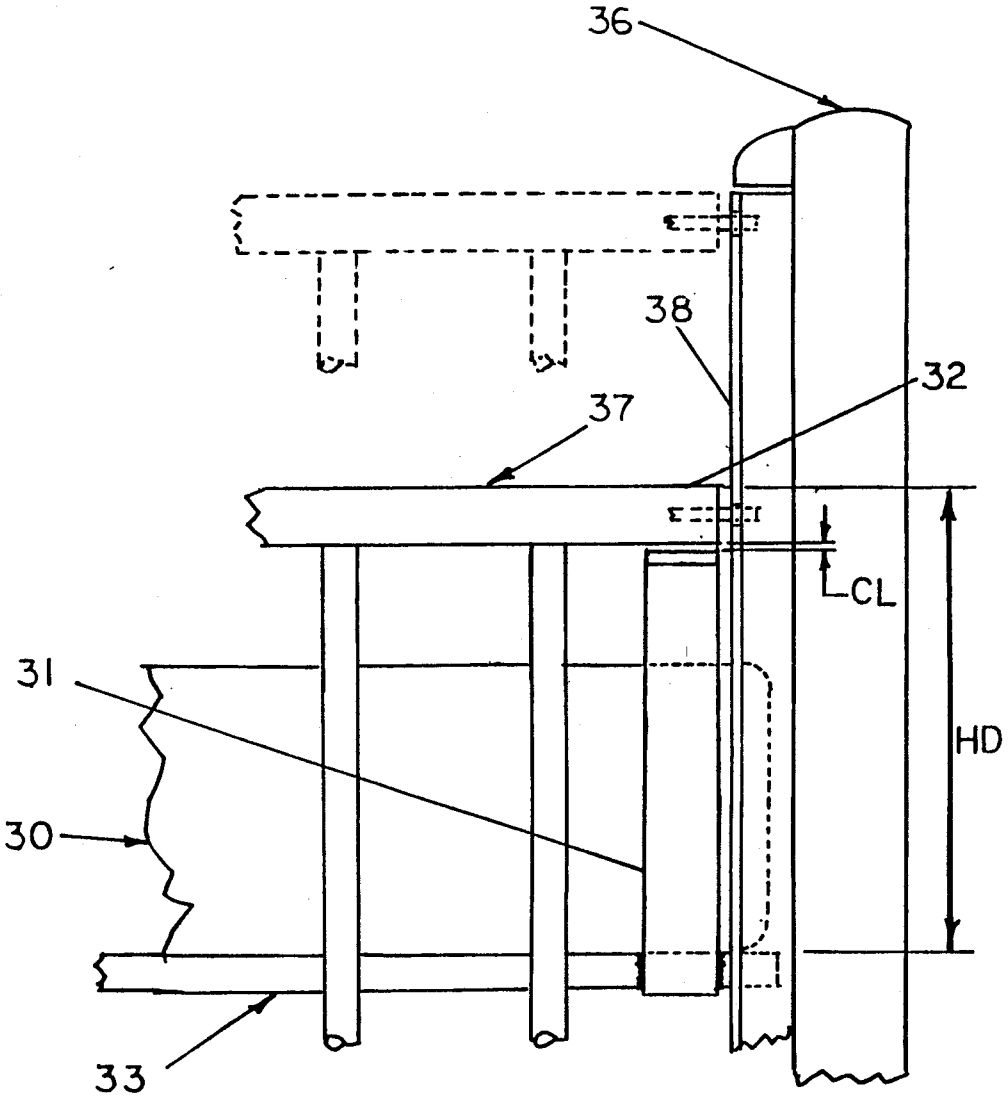
FIG. 8 is an elevation of the alternate embodiment where the stop-keeper of the preferred embodiment guards an intermediate gate down stop.

FIG. 8 shows an alternate embodiment with one of the two locking mechanisms in the top rail of the gate 37. The release mechanism (not shown) requires two simultaneous distinct actions to release.

An intermediate gate down position could be established by adding a second hole or detent in the proper location in the T-bar guide 38 as shown in FIG. 8. The weight of the gate when down would be supported by this second hole. This is not a positive method of preventing the gate 37 from going too low because of a slight parent error violating the Federal 9 inch minimum dimension of FIG. 1.

The remedy is to weld the stop 31 to the mattress support platform 33 and use a part of the gate as the keeper 32. In this case there would be a small airspace clearance between the stop 31 and the keeper 32 which is identified in FIG. 8 as CL.

The only difference between the preferred and alternate embodiments is this airspace CL.

Figure 2:
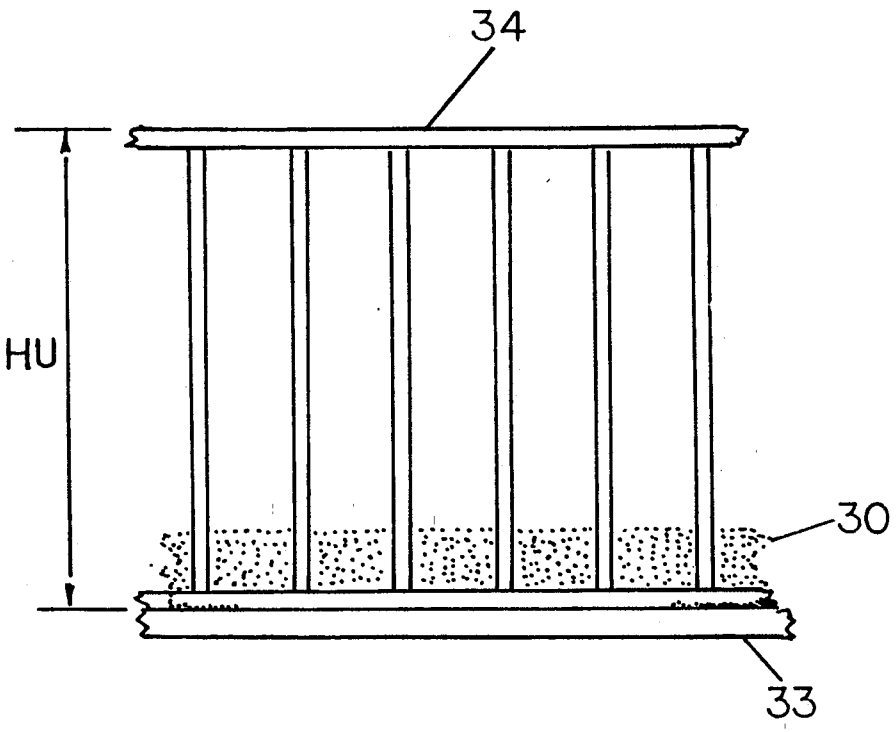
FIG. 2 is an elevation view showing CFR16 1508.3 (b) 2 requirement for 26 inch minimum distance from mattress support platform to top rail when mattress is in its lowest position and the gate is up and locked.
Figure 1:
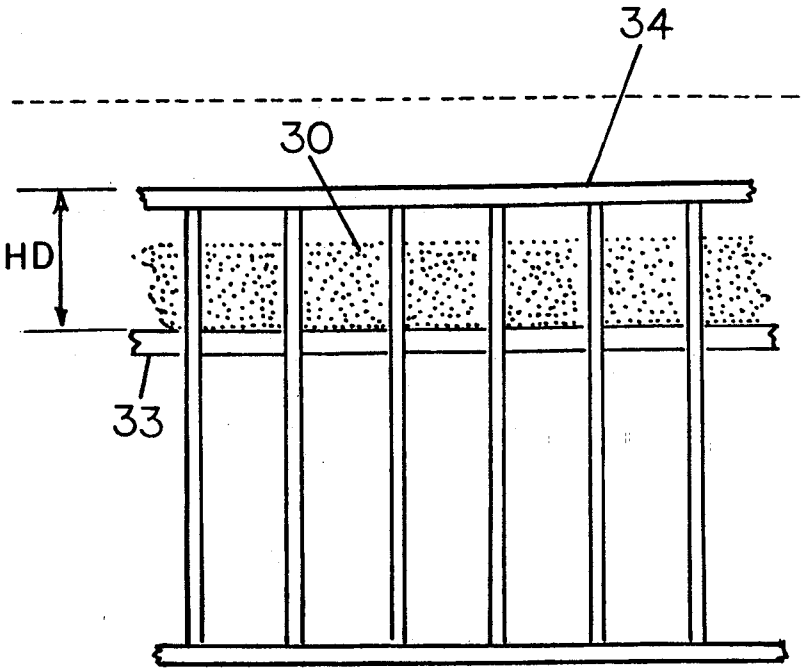
FIG. 1 is an elevation view showing CFR16 1508.3 (b) 1 requirement for 9 inch minimum distance from mattress support platform to top rail when mattress is in its highest position and the gate is down.

The Federal 9 inch minimum dimension when the gate is down and the mattress is in its highest position of FIG. 1 is shown in FIG. 8 as HD. As this dimension can be assured only by contact between the stop 31 and keeper 32, no claims are requested for the alternate embodiment.

CONCLUSION

The invention resolves a long felt, long existing but unsolved need. The increased mattress adjustment is used in two ways:

First, for a newborn just home from the hospital, when the mattress needs to be in its highest position, the top of the mattress can be 36 inches above the floor versus about 29 inches in prior art cribs. This is a back saver for parents because newborns go in and come out in a horizontal attitude.

Second, when the toddler begins to pull up to a standing position, the mattress should be in its lowest position. The invention provides about 26 inches from the top of the mattress up to the top of the top rail versus about 20 inches in prior art cribs. When the thickness of the mattress is added to the 26 inches, CFR15 1508.3 (b) 2 is exceeded by about 6 inches. This is significant because most crib accidents today are the toddler falling to the floor over the top rail.

We claim:

1. A baby crib, comprising:

(a) a pair of end boards which are substantially planar, parallel and vertical and are spaced apart from each other, each said end board mounted between and to a pair of substantially vertical posts, and (b) a first and a second gate which are substantially planar, parallel and vertical, are spaced apart from each other and are slidingly attached to said posts so as to move in a vertical direction between a bottom open position and a top closed position, and (c) a planar mattress support platform positioned between said gates and releasably attached to said posts being perpendicular thereto, and (d) stop means fixedly attached to said mattress support platform and protruding horizontally therefrom, and (e) keeper means fixedly attached to said first gate in a position to engage said stop means when said gate is moved downwardly and adapted so that said gate is supported in a position intermediate said top closed position and said bottom open position.

2. A baby crib as in claim 1, wherein said mattress support platform is adjustable in its vertical position relative to said end boards while remaining in horizontal orientation.

3. A baby crib as in claim 2, wherein said stop means and said keeper means engage one another at a position so that an upper edge of said first gate to which said keeper means is attached is at least 9 inches vertically above the level of said mattress support platform.

4. A baby crib as in claim 2, wherein said mattress support platform may be adjusted over a vertical distance of 18 inches.

5. A baby crib as in claim 4, wherein said first gate is configured to have a total height of 31½ inches and is adapted in cooperation with said posts to enable a vertical travel distance of 9½ inches.

6. A method for establishing a stop intermediate a top closed position and a bottom open position of a gate in a baby crib having a pair of opposite planar vertical end boards, a pair of opposite vertical planar gates, said gates capable of vertical movement relative to said end boards, and a horizontal mattress support platform positioned between said end boards and said gates, said method comprising:

(a) providing a horizontally protruding stop attached to said mattress support platform; and (b) attaching a keeper to one of said gates adapted to engage said stop when said gate is moved downwardly so that an upper edge of said gate is maintained at a level intermediate the vertical movement thereof.

7. The method as claimed in claim 6, further comprising configuring said stop and said keeper so that said intermediate level of said gate is at least 9 inches above the level of said mattress support platform.

* * * * *